US012116152B2

(12) United States Patent
Casale et al.

(10) Patent No.: US 12,116,152 B2
(45) Date of Patent: Oct. 15, 2024

(54) SELF-PROPELLED WRAPPING MACHINE AND WRAPPING METHOD

(71) Applicant: ROBOPAC S.P.A., Acquaviva-Gualdicciolo (SM)

(72) Inventors: Cristiano Casale, Acquaviva-Gualdicciolo (SM); Alessio Ceccanti, Acquaviva-Gualdicciolo (SM)

(73) Assignee: ROBOPAC S.P.A., Acquaviva-Gualdicciolo (SM)

( * ) Notice: Subject to any disclaimer, the term of this patent is extended or adjusted under 35 U.S.C. 154(b) by 0 days.

(21) Appl. No.: 18/019,943

(22) PCT Filed: Aug. 4, 2021

(86) PCT No.: PCT/IB2021/057134
§ 371 (c)(1),
(2) Date: Feb. 6, 2023

(87) PCT Pub. No.: WO2022/029642
PCT Pub. Date: Feb. 10, 2022

(65) Prior Publication Data

US 2024/0010372 A1 Jan. 11, 2024

(30) Foreign Application Priority Data

Aug. 6, 2020 (IT) ..... 102020000019552

(51) Int. Cl.
*B65B 11/02* (2006.01)
*B65B 41/12* (2006.01)
*B65B 57/12* (2006.01)

(52) U.S. Cl.
CPC ..... *B65B 11/025* (2013.01); *B65B 41/12* (2013.01); *B65B 57/12* (2013.01); *B65B 2210/16* (2013.01)

(58) Field of Classification Search
CPC ... B65B 11/025; B65B 2210/14; B65B 57/16; B65B 2210/16
See application file for complete search history.

(56) References Cited

U.S. PATENT DOCUMENTS 4,067,174 A * 1/1978 Goldstein ..... B65B 11/025 53/210
7,520,110 B2 * 4/2009 Asioli ..... B65B 11/025 53/589

(Continued)

FOREIGN PATENT DOCUMENTS

EP 1 852 352 11/2007
WO 99/42367 8/1999

(Continued)

OTHER PUBLICATIONS

International Search Report issued Dec. 2, 2021, in International (PCT) Application No. PCT/IB2021/057134.

*Primary Examiner* — Andrew M Tecco
(74) *Attorney, Agent, or Firm* — Wenderoth, Lind & Ponack, L.L.P.

(57) ABSTRACT

A self-propelled wrapping machine movable on a supporting plane to wrap a load with a film, comprises a self-propelled carriage and an upright fixed to said carriage and slidably supporting an unwinding unit provided with a reel of film; an anchoring element provided with a locking system selectively operable in a closed position or in an open position respectively to tighten or to release an initial flap of the film unwound from the reel; a first gripping unit adapted to position and release the anchoring element with the initial flap of film tightened by the locking system arranged on the supporting plane adjacent to the load in an initial step of the wrapping cycle, and adapted to grasp and lift the anchoring element and activate in an open position the locking system so as to release the initial flap of film after at least one turn (Continued)

travelled by the self-propelled wrapping machine around the load wrapping the load with the film.

16 Claims, 8 Drawing Sheets

(56) References Cited

U.S. PATENT DOCUMENTS

| | | | | |
|---|---|---|---|---|
| 8,938,939 | B2 * | 1/2015 | Roche | B65B 11/025 53/390 |
| 9,555,908 | B2 * | 1/2017 | Pecchenini | B65B 11/025 |
| 10,549,870 | B2 * | 2/2020 | Luo | B65B 57/08 |
| 10,689,138 | B2 * | 6/2020 | Laghi | B65B 41/16 |
| 11,492,154 | B2 * | 11/2022 | Laghi | B65B 11/025 |
| 2007/0169442 | A1 * | 7/2007 | Asioli | B65B 11/025 53/588 |
| 2012/0042615 | A1 * | 2/2012 | Roche | B65B 11/025 53/461 |
| 2014/0053502 | A1 * | 2/2014 | Pecchenini | B65B 11/025 53/218 |
| 2019/0002138 | A1 * | 1/2019 | Laghi | B65B 41/16 |

FOREIGN PATENT DOCUMENTS

| | | |
|---|---|---|
| WO | 2020/165721 | 8/2020 |
| WO | 2020/174388 | 9/2020 |

* cited by examiner

Fig. 7
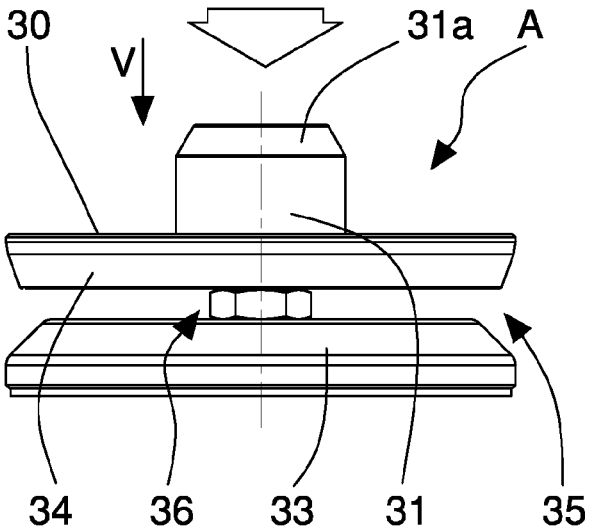
Fig. 8
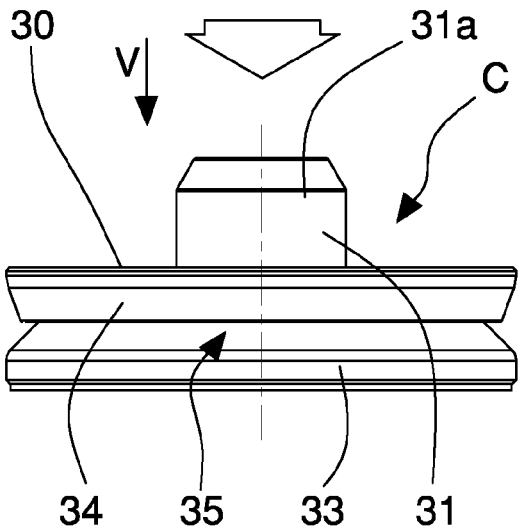
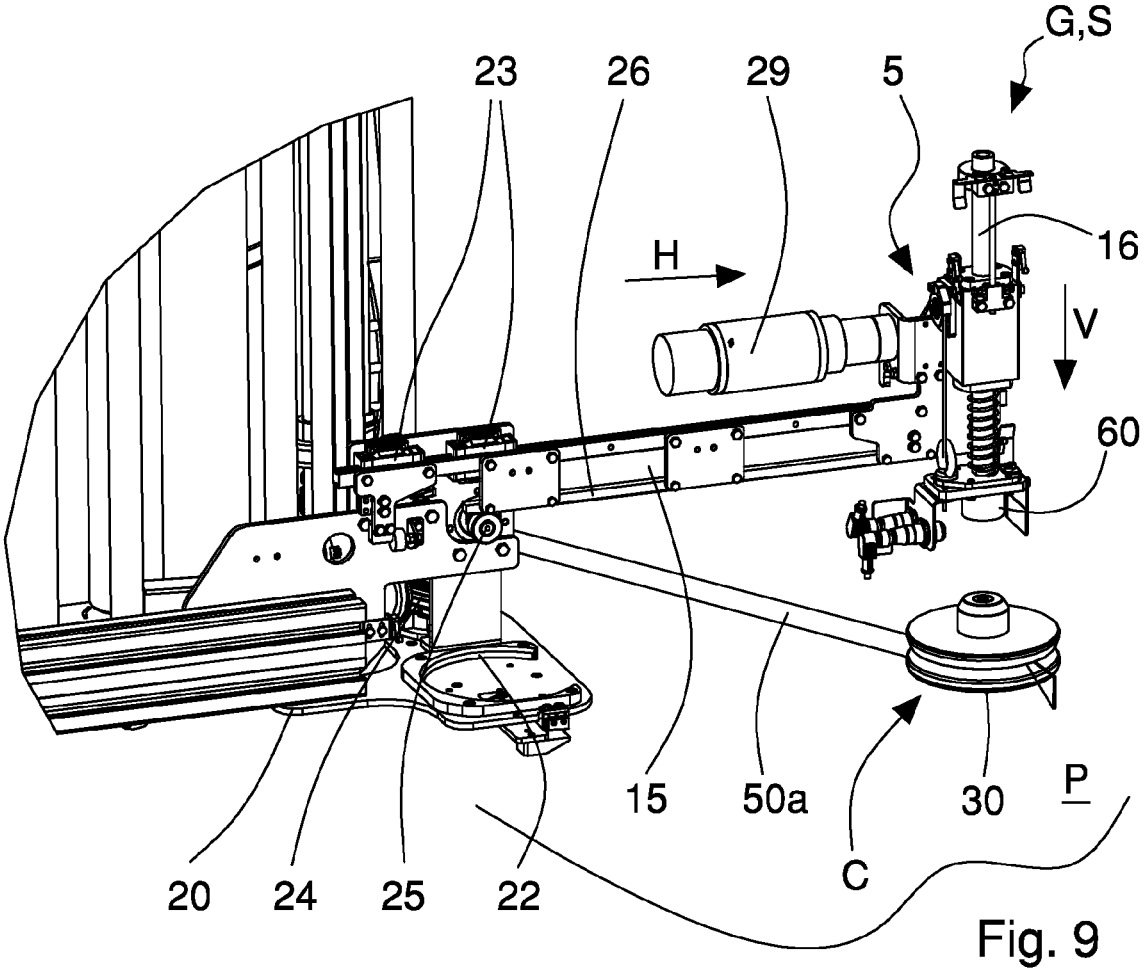
Fig. 9

SELF-PROPELLED WRAPPING MACHINE AND WRAPPING METHOD

The invention relates to a mobile or self-propelled wrapping machine arranged to wrap a film made of a plastic material around a load consisting of a product or a group of products arranged on a pallet. The invention also relates to a wrapping method implemented by the aforementioned self-propelled wrapping machine.

Self-propelled wrapping machines, also referred to as self-propelled wrapping robots, are machines generally used to wrap loads having variable shapes and sizes and in productions in limited amounts, typically in environments or rooms where fixed or static wrapping machines cannot be used because of the overall dimensions and/or available spaces. Loads are generally formed by pallets on which a group of more or less regularly overlapped products and/or objects, even having different sizes and formats, is arranged.

In other cases, the wrapping, normally for protective purposes, directly concerns the product, which is generally large-sized.

The self-propelled wrapping machines include a cart or carriage that supports a vertical upright along which a film unwinding or supplying unit, which houses a reel of plastic film and is generally provided with a plurality of rollers for unwinding and pre-stretching the film, is movable, with alternating rectilinear motion. More precisely, the unwinding unit is provided with a pair of pre-stretching rollers arranged for unwinding the film from the reel and pre-stretching or extending the film by a predefined percentage, and one or more return rollers to divert the film towards the load.

The carriage is usually provided with motorized rear drive wheels and a front driving device which comprises one or more steering wheels, operated by a steering. The steering may be operated via a guide bar by an operator to manually drive the machine in a manoeuvring configuration, or from a feeler element capable of following the external outline or shape of the load in an operational working configuration, in which the self-propelled machine turns autonomously and automatically around the load to wrap it with the film.

The combination of the alternating linear movement of the unwinding unit along the vertical upright and the rotation of the self-propelled machine around the load allows the film to be wrapped around the load so as to form a series of intertwined strips or bands. The plastic film is wrapped to completely bind up the load on all its sides.

The feeler element comprises an arm that extends externally and laterally with respect to the carriage and is provided at the end with an idle wheel capable of following the external outline of the load to be wrapped. The feeler element exerts a predefined elastic compression or thrust force on the load, so as to maintain contact with the aforementioned load and to allow the machine to move reliably around the load according to a trajectory determined by the outline of the load itself.

Self-propelled wrapping machines comprising sensors instead of the feeler element, such as ultrasonic ones, capable of detecting the external surfaces and corners of the load and processing related signals which allow a control unit of the wrapping machine to calculate a wrapping path around the load which avoids collisions, are also known. More precisely, based on the external surfaces and corners of the load detected by the sensors, the control unit controls the steering wheels and/or the driving wheels of the carriage so as to steer and drive the latter around the load.

In both types of known self-propelled wrapping machines described above, although the wrapping step takes place in a substantially automatic way, i.e., without manual intervention by an operator, the latter is needed both in an initial step of the wrapping process to fix an initial flap of the film to the load or to the underlying pallet and in a final step to cut the film and separate it from the reel.

Therefore, the aforementioned known self-propelled wrapping machines have the disadvantage of not allowing to carry out wrapping processes in a fully automated way, that is, without any manual intervention by operators.

An object of the invention is to improve the known self-propelled wrapping machines arranged to wrap a load with an extensible plastic film.

Another object is to provide a self-propelled wrapping machine which allows to wrap a load with a film in a full automatic way, without requiring any manual intervention by an operator.

A further object is to provide a self-propelled wrapping machine which allows to make firm and stable wrappings.

A first aspect of the invention provides a self-propelled wrapping machine according to claim 1.

A second aspect of the invention provides a wrapping method according to claim 14.

The invention can be better understood and implemented with reference to the attached drawings which illustrate an exemplary and non-limiting embodiment thereof, in which:

FIGS. 7 and 8 are enlarged front views of the anchoring element with locking means of the film respectively in an open position and in a closed position;

FIG. 9 is a partial enlarged view of the machine of FIG. 1 in a release step of the anchoring element;

Figure 1:
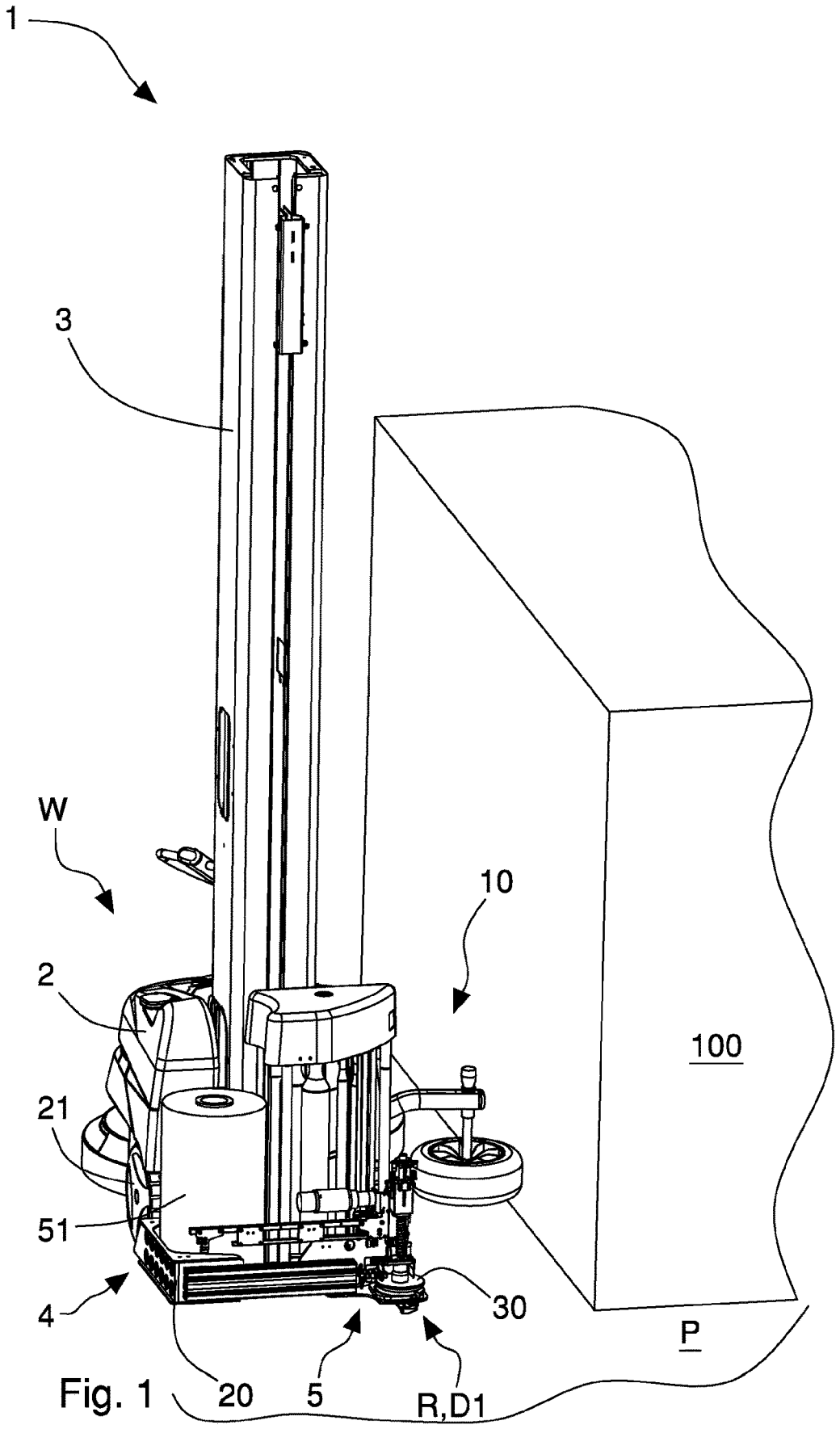
FIG. 1 is a perspective view of the self-propelled wrapping machine of the invention associated with a load to be wrapped, partially depicted, in an initial step of a wrapping cycle.

Referring to FIGS. 1 to 13, a self-propelled wrapping machine 1 according to the invention is illustrated, that is movable on a supporting plane P (for example the ground or floor of a production site) around a load 100 to wrap the latter with a film 50 made of a plastic material, in particular of the cold-extensible type, during a wrapping cycle. The load 100 consists, for example, of one or more products arranged on a pallet.

The self-propelled wrapping machine 1 comprises a self-propelled or mobile carriage 2 and an upright 3 fixed thereto and slidably supporting an unwinding unit 4. The unwinding unit 4 is provided with a reel 51 of a film 50 and roller means 41, 42, 43 for unwinding and pre-stretching the film 50. The upright 3 is substantially vertical.

The self-propelled wrapping machine 1 further comprises a first gripping unit 5 and a second gripping unit 7 both fixed to a rear supporting frame 20 of the carriage 2 and a movable anchoring element 30 to which an initial flap of film 50*a* unwound from the reel 51 can be removably fastened. More precisely, the anchoring element 30 is provided with locking means 35 which can be selectively operated in a closed position C or in an open position A respectively to tighten or release an initial flap of film 50*a*. The initial flap of film 50*a* is generated in a previous wrapping cycle performed by the self-propelled wrapping machine or is manually unwound from a new reel 51 by an operator.

The carriage 2, in particular the rear supporting frame 20, further comprises a housing 22 adapted to receive and support the anchoring element 30, when the self-propelled wrapping machine 1 is not functioning or during the wrapping step of the load 100, as better explained in the description below.

The first gripping unit 5 that is supported by the carriage 2, in particular by means of the supporting frame 20, is mobile and adapted to position and release the anchoring element associated with the initial flap of film 50*a*, which is tightened by the locking means 35 operated in the closed position C, on the supporting plane P adjacent to the load 100 in an initial step of a wrapping cycle of the load. The first gripping unit 5 is also adapted to grasp and lift the anchoring element 30 and operate the locking means 35 in the open position A so as to release the initial flap of film 50*a* after at least one turn travelled by the self-propelled wrapping machine 1 around the load 100, wrapping the latter with the film 50 delivered by the unwinding unit 4, i.e., after the film 50 has been partially wrapped and therefore fastened to the aforementioned load 100.

The second gripping unit 7 that is supported by the carriage 2, in particular via the supporting frame 20, is mobile and configured to cut a portion of the film 50 comprised between the load 100 and the unwinding unit 4, to retain a new initial flap of film 50*a* made by cutting the portion of the film 50 and transfer the new initial flap of film to the anchoring element 30 positioned in the housing 22 so as to be tightened by the locking means 35, in a final step of the wrapping cycle.

The first gripping unit 5 comprises first gripping means 6 configured to grasp and tighten the anchoring element 30. The first gripping unit 5 is movable between a retracted configuration R, in which the first gripping means 6 are adjacent to the carriage 2, and a gripping/releasing configuration G, in which the first gripping means 6 are spaced apart from the carriage 2 and adjacent to the supporting plane P, in particular for grasping or releasing the anchoring element 30 positioned on the supporting plane P.

The first gripping unit 5 comprises a first arm 15 slidably connected to the carriage 2 and movable along a first operating direction H, in particular substantially parallel to the supporting plane P, and a second arm 16 connected to a supporting end 15*a* of the first arm and extendable/retractable along a second operating position V, in particular substantially orthogonal to the supporting plane P, and supporting the first gripping means 6.

The first arm 15 is slidably supported by a pair of guiding supports 23, fixed to the rear supporting frame 20, and is moved by first driving means 24, 25, 26, 27 along the first operating direction H between a retracted position and an extended position in which the supporting end 15*a* thereof is respectively more adjacent to, and more spaced from, the carriage 2.

The first driving means comprise, for example, a first electric motor 24 fixed to the supporting frame 20 and driving by means of a first reducer 27 a pinion 25 engaged with a rack 26 fixed to the first arm 15. The pinion 25 rotating, when driven by the first electric motor 24, moves in two opposite directions the rack 26 and thus the first arm 15 linearly along the first operating direction H.

The second arm comprises, for example, a stem 16 slidably supported by a supporting guide 37 fixed to the supporting end 15*a* of the first arm 15. The second gripping means 6 are fastened to an operating end 16*a* of the stem 16.

The stem 16 is moved along the second operating position V by second driving means 28, 29, 39. Second driving means comprise elastic means 28 arranged to push and hold the stem or second arm 16 in a maximum extension configuration, in which the first gripping means 6 are further spaced from the supporting guide 37. The second driving means further comprise a first electric motor 29, fixed to the supporting end 15*a* of the first arm 15 and connected and acting on the first gripping means 6 by means of a flexible element 39 so as to move the stem 16 in opposition to the first elastic means 28, i.e., bringing the first gripping means 6 closer to the supporting guide 37.

The elastic means 28 comprise, for example, a coaxial spring mounted on the stem 16 between the supporting guide 37 and the gripping means 6 and the flexible element 39 comprises, for example, a metal cable.

Alternatively, the second driving means may comprise a linear electrical actuator adapted to support and move the first gripping means 6 along the second operating direction V in both directions.

Figure 2:
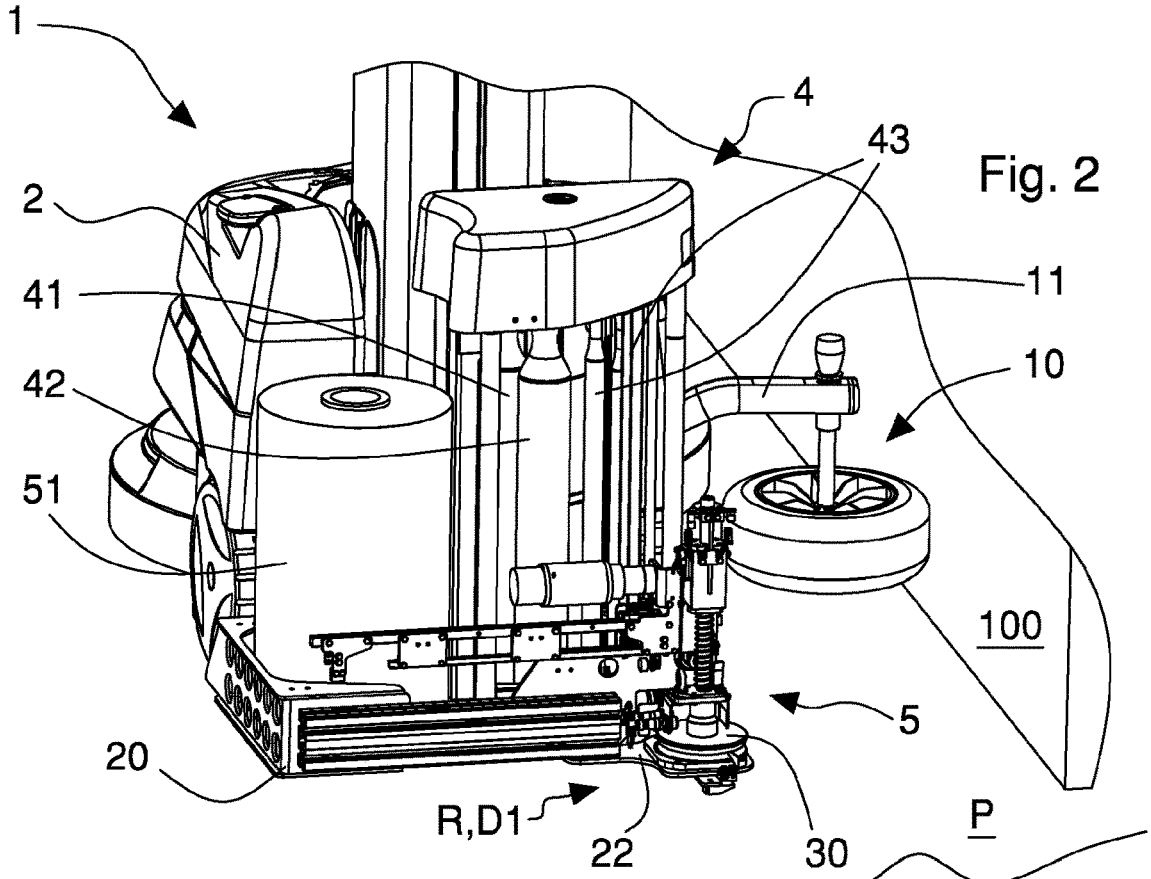
FIG. 2 is an enlarged partial detail of FIG. 1 illustrating a first gripping unit of the machine of the invention in a retracted configuration.
Figure 3:
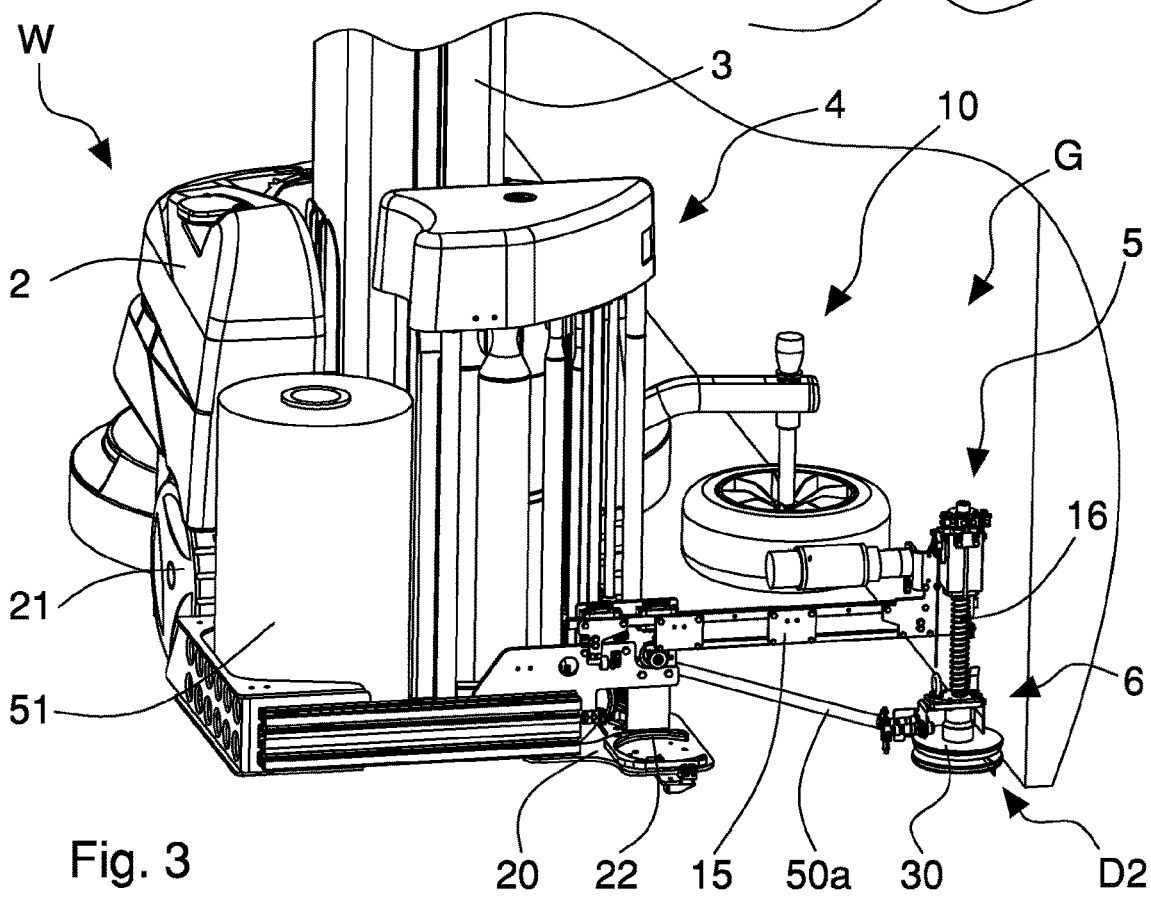
FIG. 3 is a partial enlarged view of the machine of FIG. 1 in a positioning step of an anchoring element to which an initial flap of film is associated.
Figure 4:
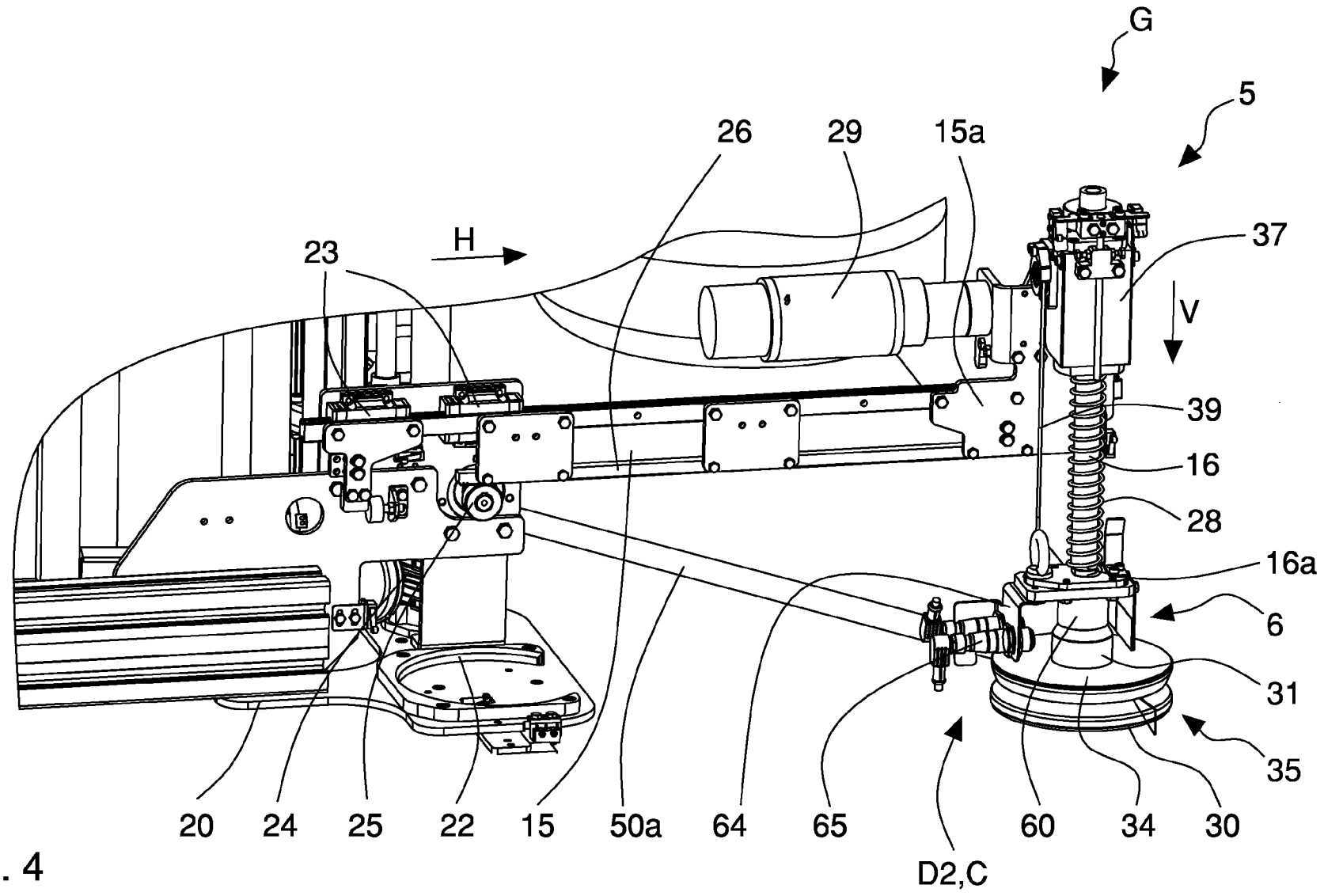
FIG. 4 is an enlarged partial detail of FIG. 3 illustrating the first gripping unit of the machine of the invention in a gripping/releasing configuration of the anchoring element.
Figure 5:
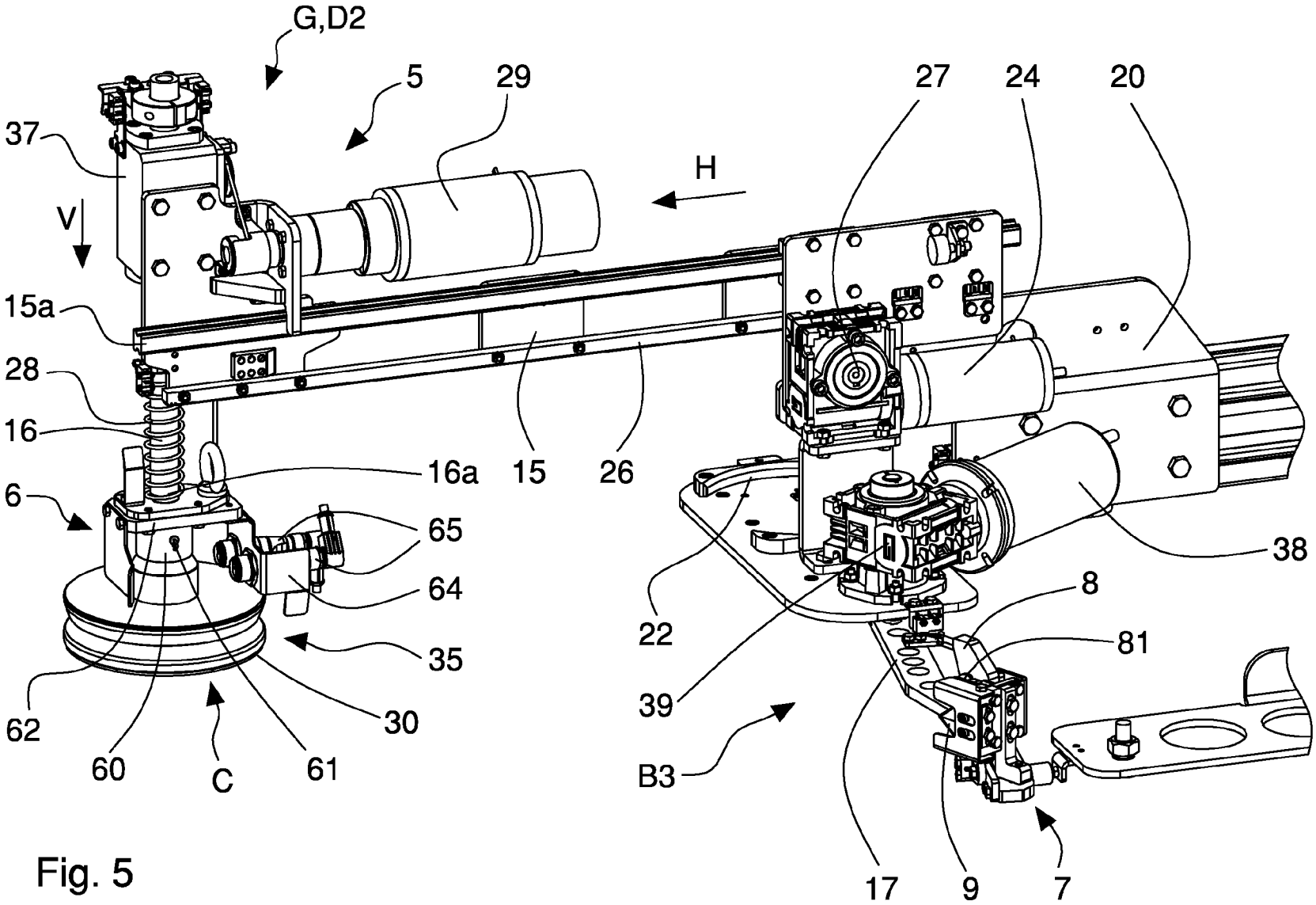
FIG. 5 is another enlarged partial perspective view of the machine of FIG. 1 in which some parts have been removed in order to better illustrate a first gripping unit in the film gripping/releasing configuration and a second gripping unit in a rest position.
Figure 6:
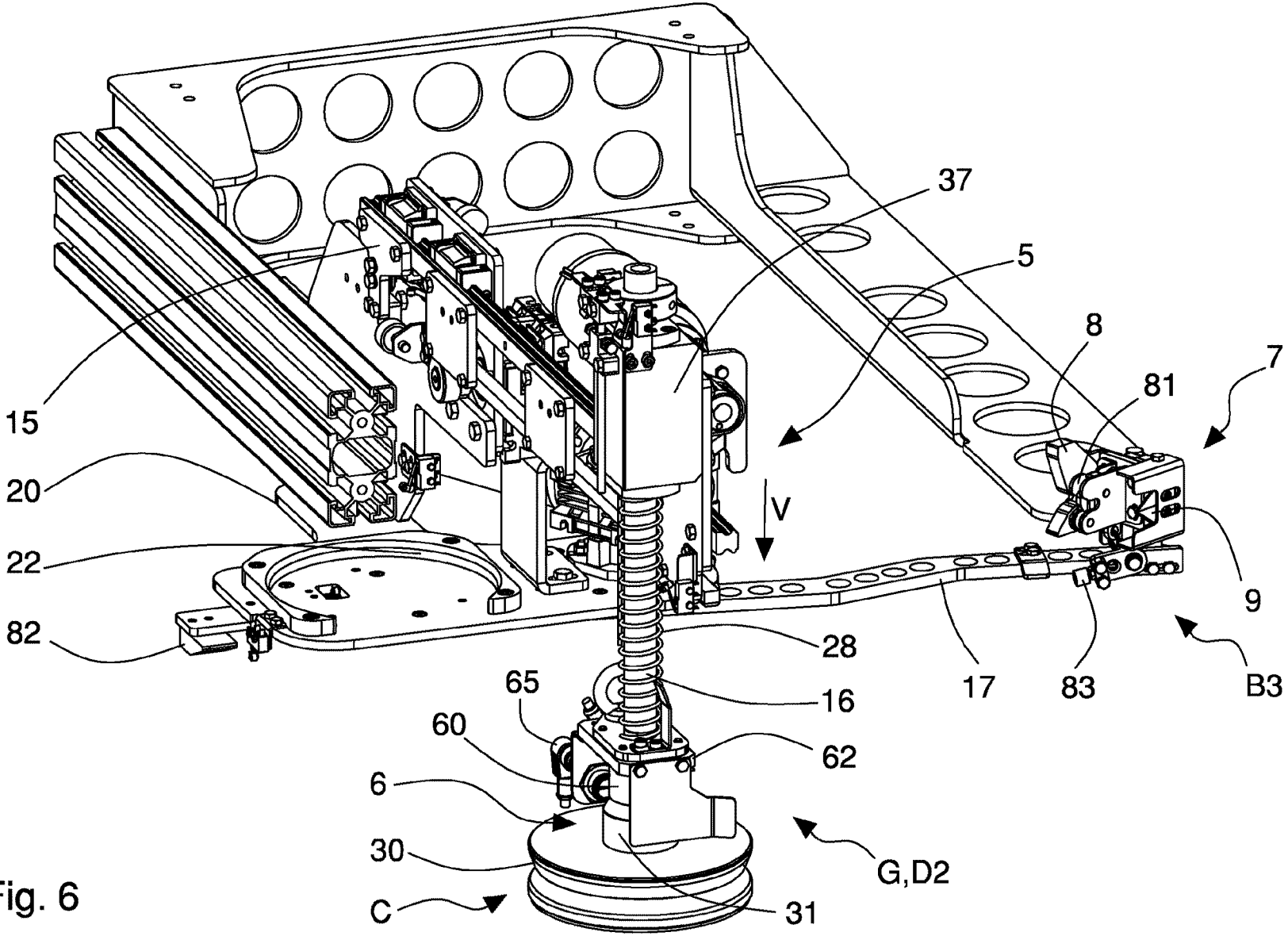
FIG. 6 is a partial perspective view and from a different angle of the machine of figure in which some parts have been removed to better illustrate the gripping units.

The second driving means 28, 29, 39 are configured to move the second gripping means 6 along the second operating position V between a raised position S, in which the second gripping means 6 are farther away from the supporting plane P, and a first and a second lowered position D1, D2 in which the second gripping means 6 are closer to the supporting plane P (FIG. 2 and FIG. 3).

More precisely, in the retracted configuration R of the first gripping unit 5, the stem 16 and first gripping means 6 are positioned by the second driving means in the first lowered position D1 so as to position the anchoring element 30 in the housing 22. In the gripping/releasing configuration G of the first gripping unit 5, the first gripping means 6 are positioned in the second lowered position D2 so as to release or take the anchoring element on/from the supporting plane P.

In the lowered positions D1, D2 the second driving means 28, 29, 39 can be further activated to move towards the supporting plane P and then return to the first or second lowered position D1, D2, with a stroke of limited amplitude, the first gripping means 6 in order to operate and bring the locking means 35 of the anchoring element 30 to the open A or closed C position, as better explained in the description below.

The first gripping means 6 comprise, for example, a sleeve or bushing 60 provided with an inner cavity adapted to receive a gripping portion 31*a* of the locking element 30 and electromagnet means 61, in particular associated with the sleeve 60, selectively activatable or deactivatable respectively to grasp or release the gripping portion 31*a*, made of ferromagnetic material.

A plate 62 is fastened to the sleeve 60 which is abutted by the coil spring 28 and to which the flexible element 39 is fastened.

Sensor means 65 are associated with the first gripping means 6 and arranged to detect the presence of the anchoring element 30 and the correct positioning with respect to the latter of the first gripping unit 5 and/or of the self-propelled wrapping machine 1. The sensor means are fixed to the plate 62 by means of a bracket 64.

With particular reference to FIGS. 7 and 8, the anchoring element 30 comprises a central pin 31 having a first end that forms the gripping portion 31*a* adapted to be grasped and retained by the first gripping unit 5, in particular by the first gripping means 6, and a first plate 33 adapted to abut the supporting plane P and slidably connected to an opposite second end of said central pin 31.

The locking means 35 comprising a second plate 34 superimposed on the first plate 33 and fixed to the central pin 31 and mobile between a closed position C, in which it abuts the first plate 33, in particular to tighten the initial flap of film 50*a* against it, and an open position A, in which it is spaced from the first plate 33, in particular to release the initial flap of film 50*a*.

The locking means 35 also comprise a locking/unlocking mechanism 36 of the known type, interposed between the central pin 31 and the first plate 33 and configured to switch the position of the second plate 34 between the open position A and the closed position C when the central pin 31 and the second plate 34 are pushed against the first plate 33 by the first gripping unit 5, more precisely by the first gripping means 6.

The anchoring element 30 has an overall weight, for example of at least 3.5 kg, such as to ensure retaining the initial flap of film 50*a* in the established position on the supporting plane P without moving during the first wrapping turn with the film 50 of the self-propelled wrapping machine 1 around the load 100.

The second gripping unit 7 comprises second gripping means 8 adapted to grasp and retain the film 50 and cutting means 9 adapted to cut the film 50.

The second gripping unit 7 is movable between a gripping and cutting position B1, a transfer position B2 and a rest position B3.

In the gripping and cutting position B1 the cutting means 9 and the second gripping means 8 are spaced from the carriage 2 respectively to cut the portion of the film 50, comprised between the unwinding unit 4 and the load 100, and to grasp and tighten the new initial flap of film 50*a* generated by cutting the film 50. In the transfer position B2 the cutting means 9 and the second gripping means 8 are adjacent to the carriage 2 and the anchoring element 30 positioned in the housing 22 of the carriage 2 so as to transfer the new initial flap of film 50*a* to the locking means 35 of the anchoring element 30, arranged in the open position A. In the rest position B3 the cutting means 9 and the second gripping means 8 are adjacent to the carriage 2 and spaced from the housing 22, in particular so as not to interfere with the wrapping of the film 50 around the load and with the movement of the first gripping unit 5.

The second gripping unit 7 comprises a third arm 17 having a respective first end 17*a* connected to the carriage 2 and a respective second end 17*b* supporting the second gripping means 8 and the cutting means 9. The third arm 17 is, for example, rotatably connected to the carriage 2 and movable along a curved path through the gripping and cutting position B1, the transfer position B2 and the rest position B3.

Third driving means 38, 39 fastened to the carriage 2 are provided to rotate the third arm 17 between the gripping and cutting position B1, the transfer position B2 and the rest position B3.

The third driving means comprise, for example, a second electric motor 38 fastened to the supporting frame 20 and driving the third arm 17 in rotation about a vertical axis, by means of a second reducer 39.

The second gripping means 8 comprise, for example, a gripper with a film locking mechanism 81 which is mechanically operated, in particular by the film 50 itself in the closed position and by an abutment 82 fixed to the supporting frame 20 of the carriage 2 in the open position, as better explained in the description below.

The cutting means 9 comprise, for example, a fixed "V"-shaped blade.

The unwinding unit 4 comprises frame means adapted to support the reel 51 and roller means 41, 42, 43 which are arranged to unwind the film 50 from the reel 51, pre-stretch and divert the film towards the load 100. More precisely, the roller means comprise a pair of pre-stretching rollers 41, 42 and one or more guide rollers 43. The pair of pre-stretching rollers 41, 42 comprises a first pre-stretching roller 41 and a second pre-stretching roller 42, rotating around respective longitudinal axes with different speeds so as to stretch or extend the film during unwinding from the reel 51 and before wrapping on the load 100.

The unwinding unit 4 further comprises folding means 13 adapted to transversely roll up and/or narrow the film 50 exiting from the roller means 41, 42, 43, so as to reduce a band width or largeness thereof or make a rolled-up or pleated portion and form a cord or strip or the like of film. The film 50 pleated or rolled to form a cord or strip can be grasped more firmly by the second gripping means 8 and more easily cut by the cutting means 9 of the second gripping unit 5 and form the two initial flaps 50*a* and the end one 50b.

The carriage 2 comprises two or more drive wheels 21, a steering wheel and guiding means for guiding the self-propelled wrapping machine 1 along a wrapping path around the load 100. More precisely, the self-propelled wrapping machine 1 is provided with a pair of rear drive wheels 21, at least one of which driven by motor means, and a front steering wheel. In the embodiment illustrated in the figures, the guiding means 10 comprise a feeler arm 11, of known type, arranged to follow an external outline of the load 100 during the wrapping step and connected to the steering wheel to steer the latter and move the carriage 2 along the wrapping path.

Alternatively, in a variant not shown of the self-propelled wrapping machine 1, the latter may comprise sensors capable of detecting external surfaces and edges of the load 100 and processing related signals, and a control unit adapted to receive said signals from the sensors, calculate a wrapping path such as to avoid collisions with the load 100 and control the guiding means 10 so as to guide the self-propelled wrapping machine 1 along the wrapping path. In this variant, the guiding means 10 comprise actuation means controlled by the control unit and arranged to steer the steering wheel or driving means also controlled by the control unit and arranged to vary the speed of the drive wheels 21.

The control unit of the self-propelled wrapping machine 1 is also arranged to operate and control in a coordinated way the movement of the carriage 2 around the load 100, the supply of film 50 from the unwinding unit 4, the movement thereof along the upright 3, the operation of gripping units 5, 7 in the different steps of the wrapping cycle.

The self-propelled wrapping machine 1 is also provided with sensor means, of known type, for example comprising photocells or capacitive sensors, or the like, capable of detecting the overall dimensions and sizes of the load 100 and the distances between the latter and the self-propelled wrapping machine 1 during operation. The signals of the sensor means are sent to the control unit of the machine to allow the correct execution of the different steps of the wrapping cycle.

In operation, the self-propelled wrapping machine 1 of the invention performs wrapping cycle of the load 100 according to the following steps.

In a first initial step the self-propelled wrapping machine 1 is positioned adjacent to the load 100, and thus activated so as to move around the load 100 for at least one turn in order to calculate and identify a defined initial position W of wrapping cycle start. More precisely, thanks to sensor means which detect the overall dimensions and sizes of the load 100, the control unit is capable to stop the self-propelled wrapping machine in the defined initial position W.

The first gripping unit 5 is arranged in the retracted configuration R and the first gripping means 6 are engaged with the gripping portion 31*a* of the anchoring element 30, which is arranged in the housing 22 of the supporting frame 20 of the carriage 2. More precisely, the first arm 15 is arranged in the retracted position R and the second arm 16 in the first lowered position D1 so that the gripping portion 31*a* of the anchoring element 30 is inserted in the sleeve 60 of the first gripping means 6.

The anchoring element 30 is associated with the initial flap of film 50*a* unwound from the reel 51, for example obtained by cutting the film at the end of a previous wrapping cycle. In particular, the initial flap of film 50*a* is retained by the locking means 35 arranged in the closed position C, that is, tightened between the two plates 33, 34 of the anchoring element 30.

In a second step, the first gripping means 6 are operated to grasp and tighten the anchoring element 30 and the first gripping unit 5 is moved from the retracted configuration R to the gripping/releasing configuration G in which the first gripping means 6 are adjacent to the load 100 and to the supporting plane P to release on the latter the anchoring element 30 to which the initial flap of film 50*a* is fastened.

More in detail, the electromagnet means 61 of the first gripping means 6 are activated so as to grasp and lock the gripping portion 31*a* of the anchoring element 30 and the second arm 16 is moved by the second driving means 28, 29, 39 so as to move the first gripping means 6 from the first lowered position D1 to the raised position S in order to lift the anchoring element 30 from the housing 22. To this end, the first motor 29 winds the cable 39 to lift the first gripping means 6 by compressing the spring 28. The first arm 15 is then moved by the first driving means 24, 25, 26, 27 along the first operating direction H between the retracted position and the extended position and then the second arm 16 is moved by the second driving means 27, 28, 39 so as to move the first gripping means 6 from the raised position S to the second lowered position D2 to put the anchoring element 30 down on the supporting plane P. To this end, the first motor 29 partially and limitedly releases the cable 39 to allow the spring 28 to lower the first gripping means 6.

In a third step, the anchoring element 30 that retains the initial flap of film 50*a* is released by the first gripping unit 5. More precisely, the electromagnet means 61 of the first gripping means 6 are deactivated to allow disengagement of the sleeve 60 from the gripping portion 31*a* of the anchoring element 30.

The first gripping unit 5 is then returned from the gripping/release configuration G to the retracted configuration R.

In a fourth step, the self-propelled wrapping machine 1 is moved around the load 100 for at least one turn so as to wrap the load with the film 50 supplied by the unwinding unit 4. The film 50, whose initial flap 50*a* is fixed to the anchoring element 30, is thus wrapped, and adheres and fastens firmly to the load 100. The film 50 is supplied by the unwinding unit 4 at full height, i.e., not rolled or narrowed transversely.

In a fifth step, the self-propelled wrapping machine 1 is stopped in the defined initial position W to allow the first gripping unit 5 to grasp and lift the anchoring element 30 from the supporting plane P after having operated the locking means 35 in the open position A so as to disengage the initial flap of film 50*a* from the anchoring element 30. More precisely, when the self-propelled wrapping machine 1 is stopped, the first gripping unit 5 is moved from the retracted configuration R to the gripping/releasing configuration G in which the first gripping means 6 are adjacent to the load 100 and to the supporting plane P and capable of grasping the anchoring element 30 and operating the locking means 35 in opening. To this end, the first gripping means 6 are moved by the first driving means 28, 29, 39 in the second lowered position D2 so as to engage the sleeve 60 in the gripping portion 31*a* and tighten it by activating the electromagnet means 61. The first gripping means 6 are further lowered and then returned to the second lowered position D2 to operate the locking/unlocking mechanism 36 of the anchoring element 30 which causes the second plate 34 of the locking means 35 to move in the open position A where the initial flap of film 50*a* can be disengaged. The first gripping unit 5 then lifts from the supporting plane P the anchoring element 30, disengaged from the initial flap of film 50*a* and with the locking means 35 in the open position A, and transfers the anchoring element to the housing 22 of the supporting frame 20 of the carriage 2. To this end, the second arm 16 is moved by the second driving means 28, 29, 39 (in particular by the first motor 29 via the cable 39) along the second operating direction V so as to move the first gripping means 6 from the second lowered position D2 to the raised position S.

Then the first arm 15 is moved by the first driving means 24, 25, 26, 27 along the first operating direction H between the extended position and the retracted position and then the second arm 16 is moved by the second driving means 28, 29, 39 along the second operating direction V (in particular by the spring 28) so as to move the first gripping means 6 from the raised position S to the first lowered position D1 to put the anchoring element 30 down in the housing 22 of the carriage 2. The anchoring element 30 has the locking means 35 still in the open position A with the second plate 34 spaced from the first plate 33.

In a sixth step, the self-propelled wrapping machine 1 is activated again to move around the load 100 for a defined number of turns so as to wrap the load with the film 50 according to a defined wrapping configuration. The wrapping step comprises, during the rotation of the carriage 2 around the load 100, moving the unwinding unit 4 with alternate motion along the upright 3 and simultaneously dispensing the pre-stretched film 50 from the unwinding unit 4.

In the last wrapping turn, the folding means of the unwinding unit 4 are operated so as to transversely roll up and/or narrow the film 50 exiting from the unwinding unit 4. For example, the film 50 is narrowed so as to form a cord or strip of limited width which can be grasped and retained more firmly by the second gripping means 8 and cut more effectively and easily by the cutting means 9 of the second gripping unit 7.

Figure 10:
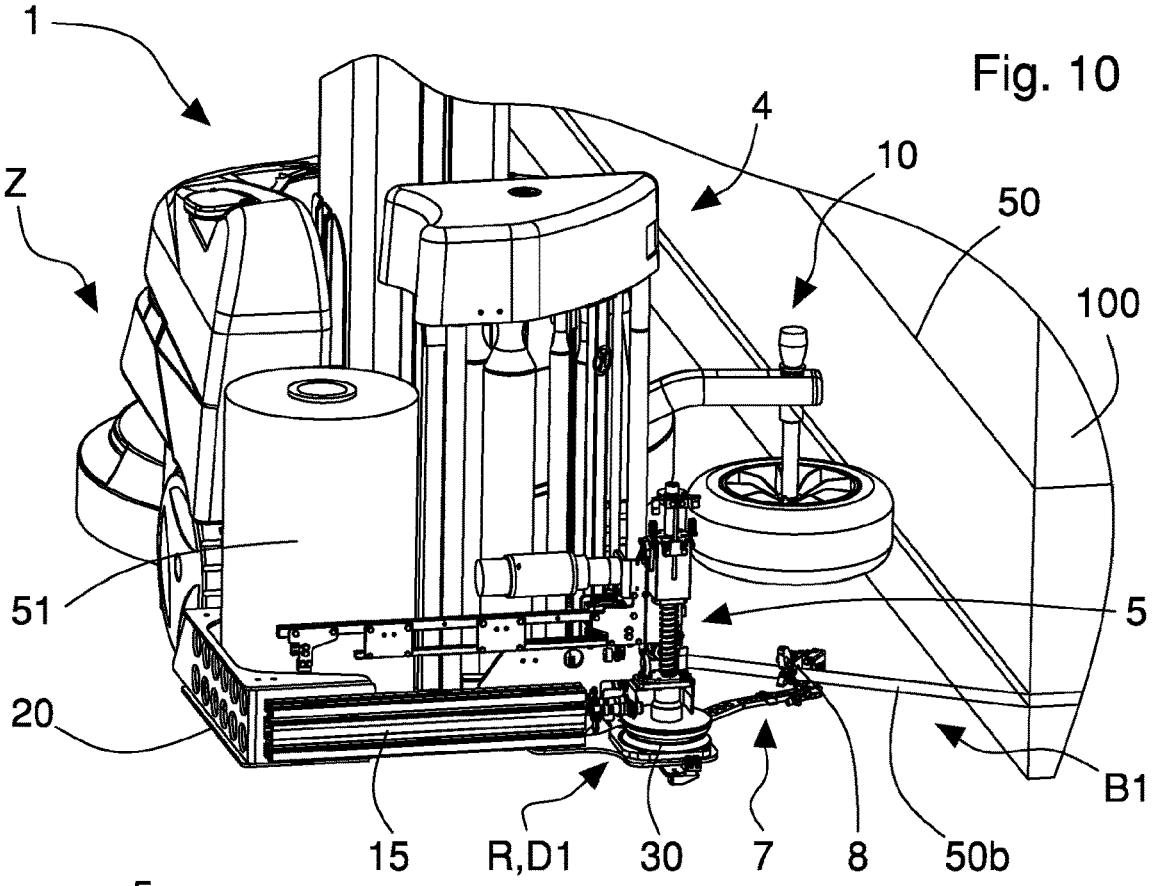
FIG. 10 is a partial enlarged view of the machine of FIG. 1 in a gripping and cutting step of the film.
Figure 13:
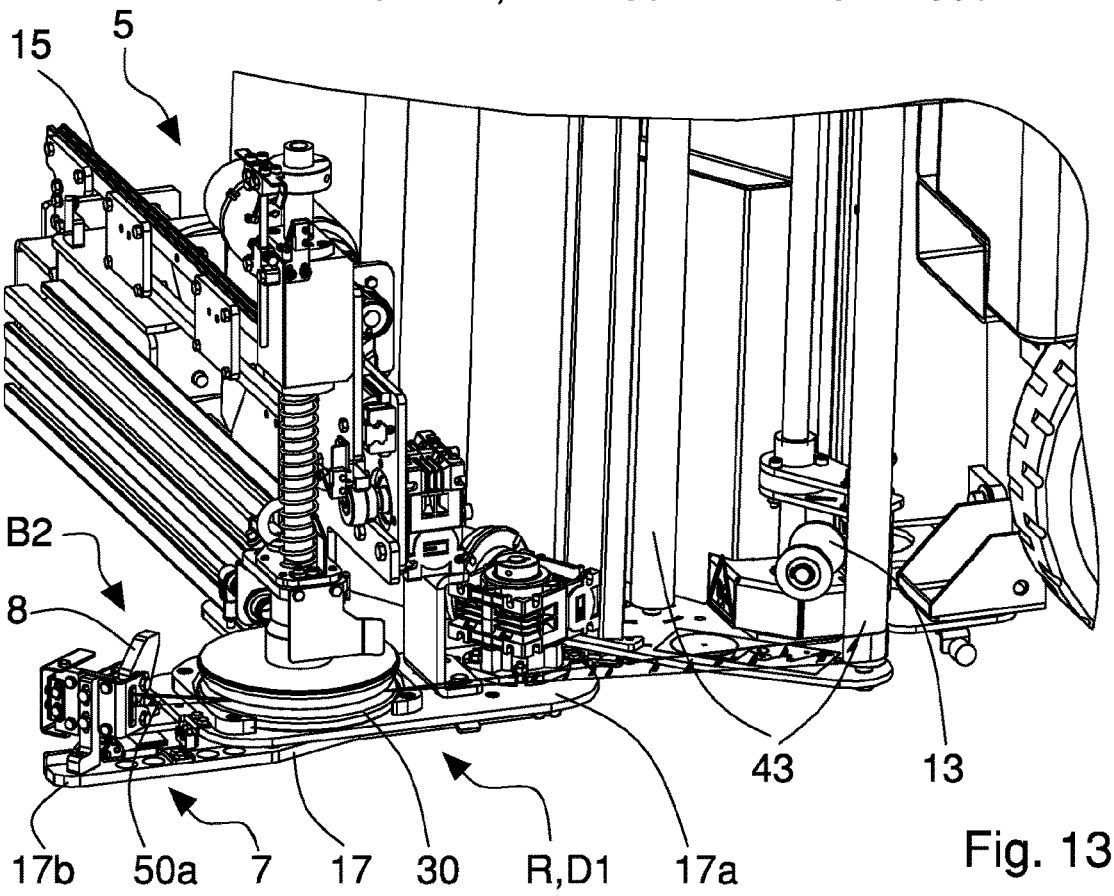
FIG. 13 is a partial perspective view illustrating the first gripping unit in a retracted configuration and the second gripping unit in a transfer position of the film.
Figure 12:
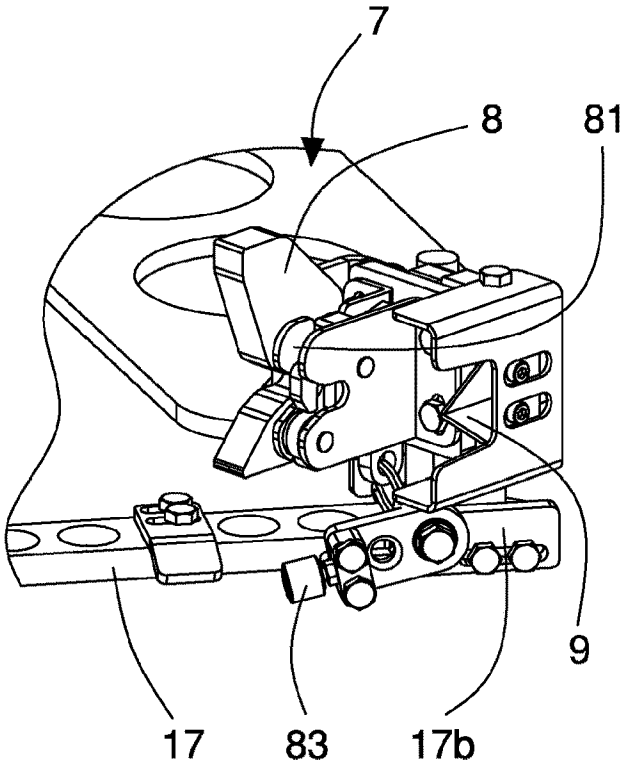
FIG. 12 is an enlarged detail of FIG. 6 illustrating gripping and cutting means of the second gripping unit.
Figure 11:
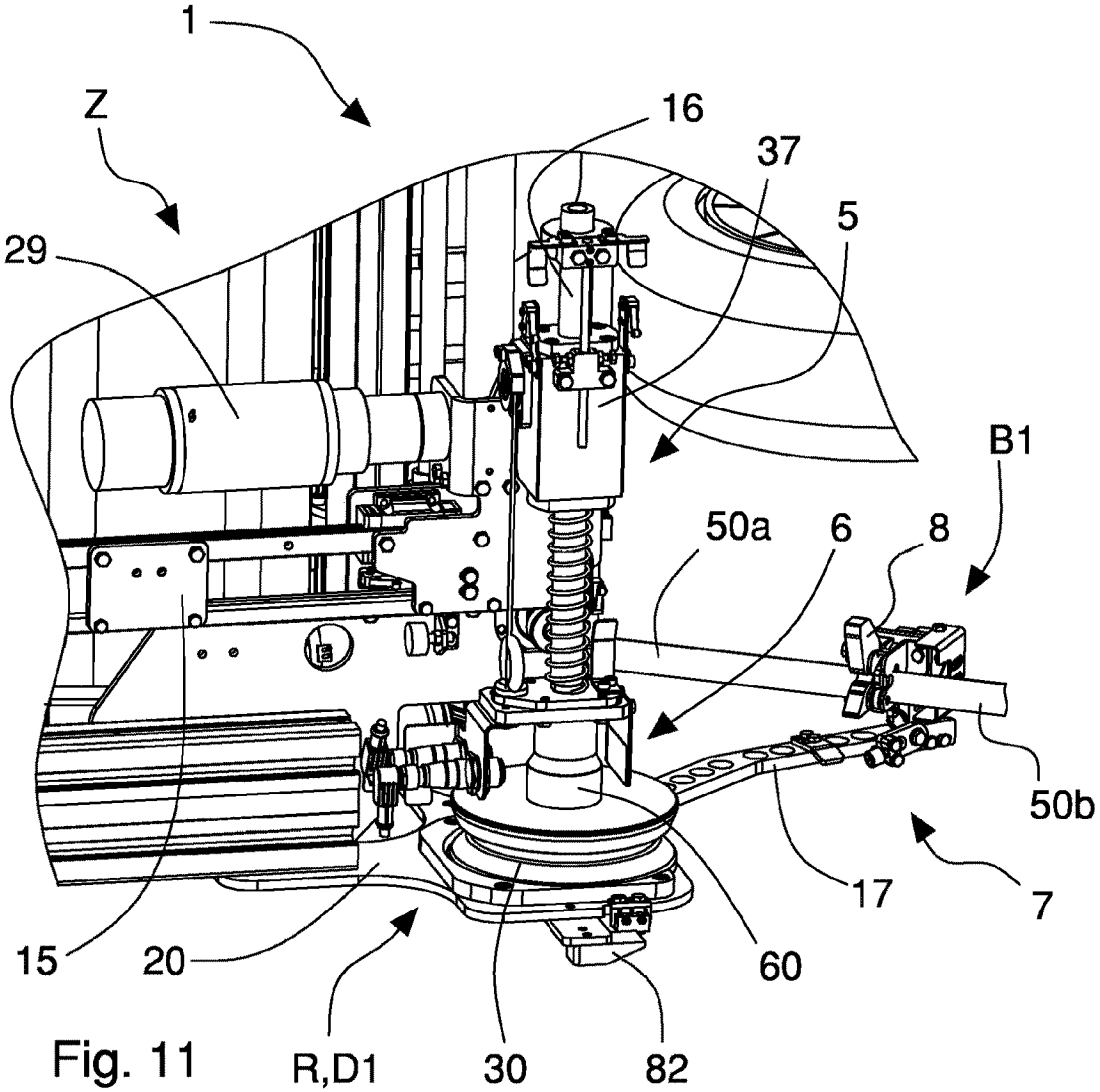
FIG. 11 is an enlarged partial detail of FIG. 10 illustrating in particular the second gripping unit in a gripping and cutting position.

In a seventh step, at the end of the wrapping, the self-propelled wrapping machine 1 is stopped in a defined final position Z, possibly coinciding with the initial position W, and the second gripping unit 7 is moved by the third driving means 38, 39 from the rest position B3, adjacent to the carriage 2, in the gripping and cutting position B1 to allow the second gripping means 8 and the cutting means 9 respectively to grasp and cut the portion of film between the unwinding unit 4 and the load 100 and create a new initial flap 50*a* and an end flap 50*b* associated with the load 100 (FIGS. 10 and 11). More precisely, during the rotation, the second gripping means 8 and the cutting means 9 intercept and stretch the film which thereby mechanically drives the locking mechanism 81 of the gripper of the second gripping means 8 in the closed position and is simultaneously cut by the blade of the cutting means 9, generating the new initial flap 50*a* retained by the locking mechanism 81 and the end flap 50*b* associated with the load 100.

In an eighth step, the second gripping unit 7 is moved by the third driving means 38, 39 in the transfer position B2 in order to transfer and release the new initial flap of film 50*a* to the locking means 35 of the locking element 30 (positioned in the housing 22 of the supporting frame 20 of the carriage 2) arranged in the open position A. More precisely, by rotating in the transfer position B2, the second gripping unit 7 inserts the initial flap of film 50*a* between the two plates 33, 34 of the anchoring element 30 spaced apart in the open position A of the locking means 35. The locking mechanism 81 is operated in the open position, so as to release the film 50, thanks to the contact of a control lever 83 of said locking mechanism of the gripper 8 with an abutment 82 fixed to the supporting frame 20.

The locking means 35 are operated in the closed position C by the first gripping unit 5, further lowering the first gripping means 6 from the first lowered position D1 and then returning them to such a first lowered position D1 so as to operate the locking/unlocking mechanism 36 of the anchoring element 30 which moves the second plate 34 of the locking means 35 in the closed position C to tighten the initial flap of film 50*a* against the first plate 33.

The second gripping unit 7 disengaged from the initial flap of film 50*a* is then returned by the third driving means 38, 39 to the rest position B3.

Therefore the self-propelled wrapping machine 1 of the invention allows to wrap a load 100 with a film 50 in a fully automatic way, i.e., without requiring any manual intervention by the operator, both in an initial step of the wrapping cycle, in which an initial flap of film 50*a* must be retained during a first wrapping turn of the film 50 around the load 100, and in a final step, in which the film 50 must be cut and the initial flap of film generated by the cut must be retained.

The anchoring element 30, which is positioned and released by the first gripping unit 5 on the supporting plane P adjacent to the load 100, thanks to the locking means 35 and its weight, allows the initial flap of film 50*a* to be firmly and safely retained in an initial step of the wrapping cycle of the load 100 in which said initial flap of film 50*a* is fixed to the load 100 by the same film 50 wound around the load.

The anchoring element 30 is then recovered from the first gripping unit 5 after the film 50 has been suitably wrapped and fixed to the load 100 with at least one wrapping turn, so as not to hinder the subsequent wrapping step. These operations are performed completely automatically, managed by the control unit of the self-propelled wrapping machine 1.

Also the operation which involves gripping and cutting the film 50 to obtain the two initial and end flaps of film 50*a*, 50*b* is performed at the end of the wrapping cycle completely automatically by the self-propelled wrapping machine 1.

The method according to the invention for wrapping a load 100 by means of the self-propelled wrapping machine 1 above described and illustrated in FIGS. 1 to 13 comprises a wrapping cycle that includes the following operating steps:

- positioning the self-propelled wrapping machine 1 mobile on the supporting plane P adjacent to the load 100 in a defined initial position W; (step 1)
- by means of a first gripping unit 5, moving an anchoring element 30, which comprises locking means 35, that retains by means of said locking means 35 operated in a closed position C an initial flap of film 50*a* unwound from a reel 51 of an unwinding unit 4 and is housed in a housing 22 of a carriage 2 of the self-propelled wrapping machine 1, and positioning the anchoring element 30 on the supporting plane P near the load 100; (step 2)
- releasing the anchoring element 30 which retains the initial flap of film 50*a* on the supporting plane P by disengaging the first gripping unit 5; (step 3)
- moving the self-propelled wrapping machine 1 around the load 100 for at least one turn, wrapping the load with the film 50 supplied by the unwinding unit 4; (step 4)
- stopping the self-propelled wrapping machine 1 in the defined initial position W and by means of the first gripping unit 5 grasping the anchoring element 30, disengaging the initial flap 50*a* from the anchoring element by operating the locking means 35 in an open position A and lifting the anchoring element 30 from the supporting plane P and transferring it to the housing 22; (step 5)
- moving the self-propelled wrapping machine 1 around the load 100 for a defined number of turns so as to wrap the load 100 with the film 50; (step 6)
- stopping the self-propelled wrapping machine 1 in a defined final position Z, and grasping and cutting with a second gripping unit 7 a portion of the film 50 comprised between the unwinding unit 4 and the load 100 to make a new initial flap of film 50*a* retained by the second gripping unit 7 and an end flap of film 50*b* associated with the load 100; (step 7)
- by means of the second gripping unit 7, transferring and associating the new initial flap of film 50*a* with the anchoring element 30 positioned in the housing 22. (step 8)

According to the method of the invention, the anchoring element 30 retains the initial flap of film 50*a* by locking means 35 operated in the closed position C by the first gripping unit in particular by first gripping means 6 of the latter also configured to grasp and tighten the anchoring element 30.

According to the method of the invention, the first gripping unit 5 disengages the initial flap of film 50*a* from the anchoring element 30 by operating the locking means 35 in the open position A, in particular by the first gripping means 6.

The method also comprises, before positioning the self-propelled wrapping machine 1 in the defined initial position W, moving the self-propelled wrapping machine around the load 100 for at least one turn so as to calculate and identify the defined initial position W.

The method also involves, before stopping the self-propelled wrapping machine 1 in the defined final position Z, transversely rolling and/or narrowing the film 50 exiting from the unwinding unit 4 in order to form a cord and/or strip of film of reduced width.

The invention claimed is:

1. A self-propelled wrapping machine movable on a supporting plane around a load to wrap the load with a film made of plastic material during a wrapping cycle, the self-propelled wrapping machine comprising:

a self-propelled carriage;

an upright fixed to said carriage and slidably supporting an unwinding unit provided with at least one reel of film;

an anchoring element provided with a locking system selectively operable in a closed position or in an open position respectively to tighten or to release an initial flap of the film unwound from the reel;

a first gripping unit supported by said carriage, movable and suitable for positioning and releasing said anchoring element, which is associated with the initial flap of film tightened by said locking system arranged in the closed position, on the supporting plane adjacent to the load in an initial step of the wrapping cycle, and suitable for grasping and lifting said anchoring element and activating, in the open position, said locking system so as to release the initial flap of film after at least one turn travelled by said self-propelled wrapping machine around the load while wrapping the load with the film delivered by said unwinding unit.

2. The self-propelled wrapping machine according to claim 1, further comprising a second gripping unit supported by said carriage, movable and configured to cut a portion of the film that is included between the load and said unwinding unit in a final step of the wrapping cycle, retain a new initial flap of the film made by cutting the portion of the film and transferring the new initial flap of film to said anchoring element positioned in a housing of said carriage so as to be tightened by said locking system.

3. The self-propelled wrapping machine according to claim 2, wherein said second gripping unit comprises a second gripping assembly adapted to grasp and retain the film and a cutting system adapted to cut the film, said second gripping unit being movable between a gripping and cutting position, in which said cutting system and said second gripping assembly are spaced apart from said carriage respectively for cutting the portion of the film and for grasping and retaining the new initial flap of film generated by cutting the film, a transfer position, in which said cutting system and said second gripping assembly are adjacent to said carriage and to said anchoring element that is positioned in said housing of said carriage for transferring the new initial flap of film to said locking system of said anchoring element, and a rest position, in which said cutting system and said second gripping assembly are adjacent to said carriage and spaced from said housing.

4. The self-propelled wrapping machine according to claim 3, wherein said second gripping unit further comprises a third arm, having a first end connected to said carriage and a second end supporting said second gripping assembly and said cutting system, said third arm being rotatably connected to said carriage and movable along a curved path between the gripping and cutting position, the transfer position and the rest position.

5. The self-propelled wrapping machine according to claim 2, wherein said carriage comprises a rear supporting frame adapted to support said first gripping unit and said second gripping unit and provided with said housing suitable for receiving and supporting said anchoring element at least during a wrapping step of the load, said anchoring element being positioned in or taken from said housing by said first gripping unit arranged in a retracted configuration.

6. The self-propelled wrapping machine according to claim 1, wherein said first gripping unit comprises a first gripping assembly configured to grasp and retain said anchoring element, said first gripping unit being movable between a retracted configuration, in which said first gripping assembly is adjacent to said carriage, for positioning or removing said anchoring element into/from a housing of said carriage, and a gripping/releasing configuration, in which said first gripping assembly is spaced from said carriage and adjacent to the supporting plane for grasping or releasing said anchoring element on the supporting plane.

7. The self-propelled wrapping machine according to claim 6, wherein said first gripping assembly comprises an electromagnet device selectively activated or deactivated respectively to grasp or release a gripping portion of said anchoring element.

8. The self-propelled wrapping machine according to claim 6, wherein said first gripping unit further comprises a first arm slidably connected to said carriage and movable along a first operating direction and a second arm connected to a supporting end of said first arm and extendable/retractable along a second operating direction and supporting said first gripping assembly.

9. The self-propelled wrapping machine according to claim 8, wherein the first operating direction is substantially parallel to the supporting plane and the second operating direction is substantially orthogonal to the supporting plane.

10. The self-propelled wrapping machine according to claim 8, further comprising a first driving assembly for moving said first arm along the first operating direction between a retracted position and an extended position wherein said supporting end of said first arm is respectively more adjacent to, and more spaced from, said carriage, and a second driving assembly for moving said second arm along the second operating direction at least between a raised position and first and second lowered positions, wherein said second arm is respectively farther from and closer to the supporting plane.

11. The self-propelled wrapping machine according to claim 1, wherein said anchoring element comprises a central pin having a first end provided with a gripping portion arranged to be grasped and held by said first gripping unit and a first plate suitable for meeting the supporting plane and slidably connected to an opposite second end of said central pin, said locking system comprising a second plate placed upon said first plate, fixed to said central pin and movable between a closed position, wherein said second plate abuts said first plate for tightening the initial flap of film against said first plate, and an open position, in which said second plate is spaced from said first plate for releasing the initial flap of film.

12. The self-propelled wrapping machine according to claim 11, wherein said locking system further comprises a locking/unlocking mechanism interposed between said central pin and said first plate and configured to switch a position of said second plate between the open position and the closed position when said second plate and said central pin are pushed against said first plate by said first gripping unit.

13. The self-propelled wrapping machine according to claim 1, wherein said unwinding unit comprises a roller assembly for pre-stretching and unwinding the film and a folding device for rolling and/or transversely pleating the film exiting said roller assembly, said first gripping unit grasping and holding in a final step of the wrapping cycle a rolled and/or narrowed portion of the film included between said unwinding unit and the load.

14. The self-propelled wrapping machine according to claim 1, further comprising a sensor system for detecting dimensions of the load and/or distances between the load and said self-propelled wrapping machine during operation.

15. A method for wrapping a load by means of a self-propelled wrapping machine according to claim 1, the method comprising in a wrapping cycle the steps of:

positioning said self-propelled wrapping machine mobile on the supporting plane adjacent to the load in a defined initial position;

by means of said first gripping unit, moving said anchoring element provided with said locking system, which retains the initial flap of film unwound from the reel of said unwinding unit by means of said locking system operated in the closed position and is housed in a housing of a body of said self-propelled wrapping machine, and positioning said anchoring element on the supporting plane near the load;

releasing on the supporting plane said anchoring element, which holds the initial flap of film, so as to disengage said first gripping unit;

moving said self-propelled wrapping machine around the load for at least one turn and wrapping the load with the film supplied by said unwinding unit;

stopping said self-propelled wrapping machine in the defined initial position and by means of said first gripping unit grasping said anchoring element, disengaging the initial flap from said anchoring element by operating said locking system in the open position and lifting from the supporting plane and transferring into said housing said anchoring element;

moving said self-propelled wrapping machine around the load for a defined number of turns and wrapping the load with the film;

stopping said self-propelled wrapping machine in a defined final position and grasping and cutting with a second gripping unit a portion of the film included between said unwinding unit and the load in order to obtain a new initial flap of the film that is retained by the second gripping unit and an end flap of film associated with the load; and by means of the second gripping unit, transferring and associating the new initial flap of film to said anchoring element positioned in the housing.

16. The method according to claim 15, further comprising, before said positioning of said self-propelled wrapping machine in the defined initial position, moving said self-propelled wrapping machine around the load for at least one turn in order to calculate and detect the defined initial position.

* * * * *